United States Patent [19]

Nakatsuka

[11] 4,388,486

[45] Jun. 14, 1983

[54] SHIELDED LINE

[75] Inventor: Hisayoshi Nakatsuka, Mitaka, Japan

[73] Assignee: Namiki Precision Jewel Co., Ltd., Tokyo, Japan

[21] Appl. No.: 251,890

[22] Filed: Apr. 7, 1981

[30] Foreign Application Priority Data

Apr. 25, 1980 [JP] Japan ..... 55-057225[U]

[51] Int. Cl.[3] ..... H01B 11/06

[52] U.S. Cl. ..... 174/34; 174/36; 179/78 R

[58] Field of Search ..... 174/32, 17, 33, 34, 174/35 R, 36, 78; 333/24 R; 179/78 R; 178/63

[56] References Cited

U.S. PATENT DOCUMENTS 2,526,942 10/1950 Fuchs ..... 174/36 X
2,684,993 7/1954 Bowers ..... 174/34 X

FOREIGN PATENT DOCUMENTS 1170486 4/1960 Fed. Rep. of Germany ..... 174/34
184016 8/1922 United Kingdom ..... 174/34
272407 6/1927 United Kingdom ..... 174/34
734164 7/1955 United Kingdom ..... 174/34

*Primary Examiner*—Volodymyr Y. Mayewsky
*Attorney, Agent, or Firm*—Gerald J. Ferguson, Jr.; Joseph J. Baker

[57] ABSTRACT

A shielded line comprising a central wire; a shielding conductor disposed around the central wire; and the central wire and shielding conductor being divided into first, second and third parts where (a) the central wires of the first and third parts are connected to the shielding conductor of the second part and (b) the central wire of the second part is connected to the shielding conductors of the first and third parts so that a signal applied to the central wire of the first part flows through the central wire of the first part, the shielding conductor of the second part and the central wire of the third part and a signal applied to the shielding conductor of the first part flows through the shielding conductor of the first part, the central wire of the second part and the shielding conductor of the third part.

4 Claims, 5 Drawing Figures

SHIELDED LINE

BACKGROUND AND OBJECTS OF THE INVENTION

This invention relates to an improvement of the signal transmission lines and, mainly, to single wire, shielded, coaxial lines.

Single wire, shielded, coaxial lines have heretofore had plugs 1 at both ends as illustrated in FIG. 1. A braided, shielding conductor 3 around central wire 2 is provided with insulating material in between. The conductor 3 eliminates the mutual inductance and also prevents the electromagnetic coupling. Generally, a signal line (not shown) is connected to central wire 2 and the earth line (not shown) to the shielding conductor 3. Accordingly, the signal voltage of and current in shielding conductor 3 are constantly subjected to electrostatic influence by external electrostatic fields. Thus, for example, external AC fields modify the electric potential between two lines 2 and 3 and accordingly generate induced current. Hence, the transmitted signal is distorted with an attendant reduction in S/N ratio.

It is thus an object of this invention to provide a shielded, coaxial line which lessens the aforesaid defects by reducing induced current and minimizing the electric potential difference between the signal line and the earth line.

Other objects and advantages of this invention will be apparent from a reading of the following specification and claims taken with the drawing.

DETAILED DESCRIPTION OF EMBODIMENTS OF THE INVENTION

Figure 1:
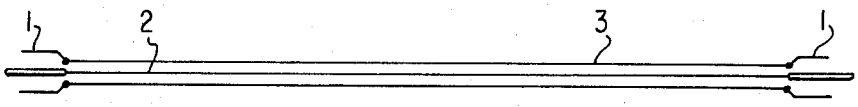
FIG. 1 Prior Art
FIG. 1 is a wiring diagram showing a conventional single wire, coaxial, shielded line.

Reference should be made to the drawing where like reference numerals refer to like parts.

Figure 2:
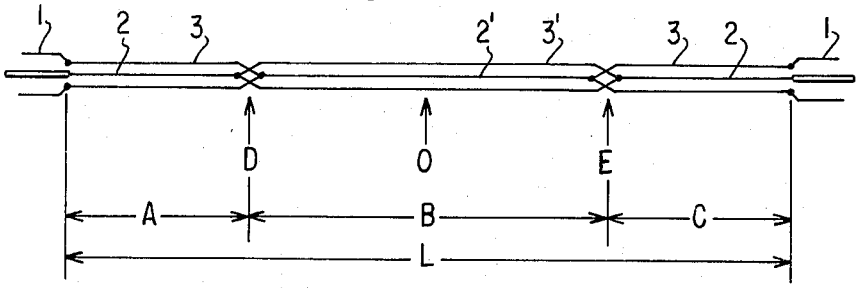
FIG. 2 is a wiring diagram of an illustrative single wire, coaxial, shielded line in accordance with the invention.

FIG. 2 is a wiring diagram of a distribution line of this invention illustrating the relationship between the central wire of a single wire, shielded line and the shielding conductor and with plugs 1 on both ends. The effective length L is divided into parts A, B, and C with A and C corresponding to the relationship of existing central wires and shielding conductor 3. Core part B reverses the signal route extending through the central line 2′ and the shielding conductor 3′. Thus, at point D, shielding conductor 3 of part A is connected to central wire 2′ of part B and central wire 2 of part A is connected to shielding conductor 3′ of part B. Also at point E, the central wire 2′ of part B is connected to shielding conductor 3 of part C and shielding conductor 3′ of part B is connected to central wire 2 of part C. Accordingly, the input current from the signal line is transmitted via 2 of part A, 3′ of part B, and 2 of part C while the input current from the earth line is transmitted via 3 of part A, 2′ of part B, and 3 of part C. Also, the ratio of the effective length of the (A+C) parts to the effective length of part B should preferably be 1:1 where the position of part B need not be restricted to the central portion of the shielded line. Rather, part B may be randomly positioned although the phase of the input signal to part A should be equal to that of the output signal from part C. That is, there should be three or an odd number of parts to restore at the output the original phase relation at the input.

Figure 3:
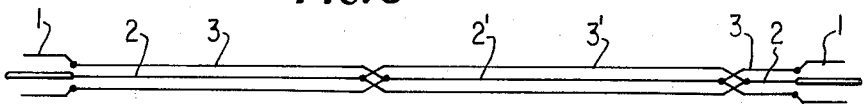
FIGS. 3 and 4 are wiring diagrams of other illustrative, single wire, coaxial, shielded lines of the invention.

FIG. 3 is a wiring diagram of a modified, distribution line in accordance with the invention where the signal current of the earth line flows through the shielding conductor at the parts A and C corresponding to A and C of FIG. 2. Since the signal current of the signal line flows through the shielding conductor at part B, an equal amount of electrostatic influence and magnetic influence occur due to external electrostatic fields. Thus, an external AC field goes through both the signal line and the earth line and make it possible to reduce the relative potential difference between the lines and the induced current. Also, despite the slight difference of the pure resistance value with the central wire and the shielding conductor of conventional, coaxial lines, it can be recognized that the resistance value of the signal and earth lines is exactly the same in the present invention.

Figure 4:
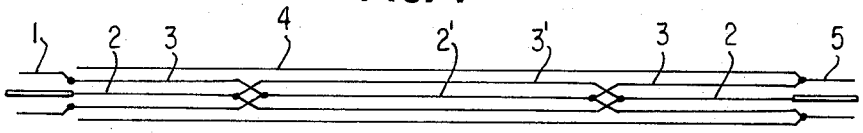
Figure 5:
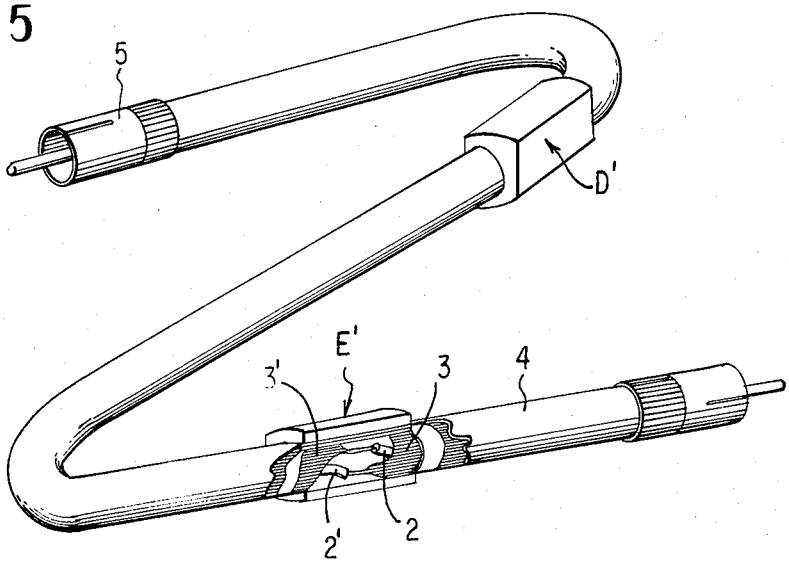
FIG. 5 is a perspective view of the coaxial line of FIG. 4 where part E′ shows illustrative internal structure in detail.

A shielded line (FIG. 4) having a double shielding function may also be implemented by providing a conductive shield 4 around over the shielding line of FIG. 2 and connecting shield 4 to plug 5 on one end of the ground. In one working implementation (FIG. 5) of the FIG. 4 embodiment, an audio phono-cord is provided. Each central wire is connected to one of the shielding conductors at a position $\frac{1}{4}$ (D′ part) and $\frac{3}{4}$ (E′ part) of the effective length from the plug 5. Of course, the shielding conductors are also connected to the central wires at these points to one of the core lines. No distortion occurs so that a balanced regenerated tone quantity results with a good rise from low to high level hearing sensitivity.

In another working implementation of the invention, an improved effect equal to the regenerative tone quantity obtained with the above-mentioned working implementation was also produced for an audio speaker cord with the shielded line structure of this invention.

Although the embodiments and implementations of this invention have been described for audio, the shielded line of this invention is not limited to single wire, shielded, coaxial lines and other shielded lines in accordance with the invention may be used for telecommunication or measuring devices or other transmission systems. Further, the shielded line described hereinbefore may be replaced with other lines such as parallel lines, twisted pair lines, etc.

Thus, this invention lessens the distortion and the reduction in S/N ratio caused by external field induction.

It is to be understood that the above detailed description of the various embodiments of the invention is provided by way of example only. Various details of design and construction may be modified without departing from the true spirit and scope of the invention as set forth in the appended claims.

What is claimed is:

1. A shielded line comprising a inner wire having first and second ends;

a shielding conductor disposed around the inner wire, said shielding conductor having first and second ends where the shielding conductor including the first and second ends there is electrically insulated from the inner wire including the first and second ends thereof; and said inner wire and shielding conductor being divided into first, second and third parts where (a) the inner wires of the first and third parts are connected to the shielding conductor of the second part and (b) the inner wire of the second part is connected to the shielding conductors of the first and third parts so that a signal applied to the inner wire of the first part flows through the inner wire of the first part, the shielding conductor of the second part and the inner wire of the third part and a signal applied to the shielding conductor of the first part flows through the shielding conductor of the first part, the inner wire of the second part and the shielding conductor of the third part and where the effective length of the first and third parts is substantially equal to that of the second part.

2. A shielded line comprising:

a central wire;

a shielding conductor disposed around the central wire and electrically insulated therefrom;

a conductive shield disposed over the shielding conductor and connected thereto at one end thereof; and said central wire and shielding conductor being divided into first, second and third parts where (a) the central wires of the first and third parts are connected to the shielding conductor of the second part and (b) the central wire of the second part is connected to the shielding conductors of the first and third parts so that a signal applied to the central wire of the first part flows through the central wire of the first part, the shielding conductor of the second part and the central wire of the third part and a signal applied to the shielding conductor of the first part flows through the shielding conductor of the first part, the central wire of the second part and the shielding conductor of the third part and where the effective length of the first and third parts is substantially equal to that of the second part.

3. A shielded line as in claim 1 or 2 where said shielding conductor is coaxially disposed with respect to the inner wire.

4. A shielded line as in claim 1 including a conductive shield disposed over the shielding conductor and connected thereto at one end thereof.

* * * * *